United States Patent [19]

Bernier

[11] Patent Number: 4,836,076

[45] Date of Patent: Jun. 6, 1989

[54] MOLDED SOUND BOX FOR VIOLIN AND THE LIKE

[76] Inventor: Michel M. Bernier, 42, St-Michel, St-Elie-D'Orford, Quebec, Canada, J0B 2S0

[21] Appl. No.: 214,485

[22] Filed: Jul. 1, 1988

[51] Int. Cl.[4] ..... G10D 1/02

[52] U.S. Cl. ..... 84/275; 84/291

[58] Field of Search ..... 84/274–277, 84/291

[56] References Cited

U.S. PATENT DOCUMENTS

| | | | |
|---|---|---|---|
| 572,906 | 12/1896 | Mc Nichol | 84/275 |
| 2,588,101 | 3/1952 | Finder | 84/291 |
| 3,186,288 | 6/1965 | Finch | 84/275 |

FOREIGN PATENT DOCUMENTS

| | | | |
|---|---|---|---|
| 45462 | 2/1982 | European Pat. Off. | 84/276 |
| 573079 | 3/1933 | Fed. Rep. of Germany | 84/275 |
| 51656 | 4/1890 | Fed. Rep. of Germany | 84/275 |
| 653516 | 3/1929 | France | 84/276 |
| 6340 | 4/1887 | United Kingdom | 84/277 |

*Primary Examiner*—Lawrence R. Franklin

*Attorney, Agent, or Firm*—Roland L. Morneau

[57] ABSTRACT

A sound box for violin, made of molded plastic, is made of a lower and upper sound board and an intermediate surrounding sidewall sealed together. The sound boards are molded with ribs on their internal surface. The handle is molded with the lower board and extends from a large axial rib on the latter. The handle and the large rib have a core made of hard wood.

11 Claims, 2 Drawing Sheets

MOLDED SOUND BOX FOR VIOLIN AND THE LIKE

BACKGROUND OF THE INVENTION

1. Field of the Invention:

A sound box for violin and the like is made of molded plastic for providing the rigidity, the solidity and for being temperture and humidity resistant. The new sound box is also shaped with ribs for providing a musicality of quality.

2. Prior art:

Commonly known violins are made of wood and require expert hands. They include a large number of precisely shaped parts meticulously assembled and glued. For example, the upper and lower sound boards are hand curved to obtain a thickness progressively increasing from both sides to the central longitudinal axis. Each violin has its own tonality because no two violins are identical. The long time required to make one violin and the scarcity of the skilled labor raise the cost of one instrument beyong the purchasing limit of many people tempted to buy one in order to test their interest or ability on a violin.

SUMMARY OF THE INVENTION

The sound box of a violin or the like according to the invention is made of molded plastic and has substantially the same exterior shape as the commonly known violin made of wood. The instrument comprises a lower and an upper sound board sealed to a peripheral sidewall. The lower board has a generally uniform thickness over which are internally sealed or molded a series of ribs. A large main rib extends along longitudinal axis of the violin and tapers in cross-section from both ends to a location adjacent the center portion of the lower board. The lower board has an internal flat portion of increased thickness at such a location adapted to support a sound post. Both ends of the main rib are sealed to the sidewall. Two similar series of secondary ribs extend for both sides of the large rib towards the sidewall. The handle is integrally molded with the lower board. The handle and the large rib has preferably a wooden core. The inner surface of the upper sound board is provided with a bass bar axially molded to the upper board. The bass bar is made of plastic and has preferably a wooden core. On each side of the bass bar, the upper board has the usual double soundholes. The upper and lower boards are sealed to the sidewall of the box.

Figure 1:
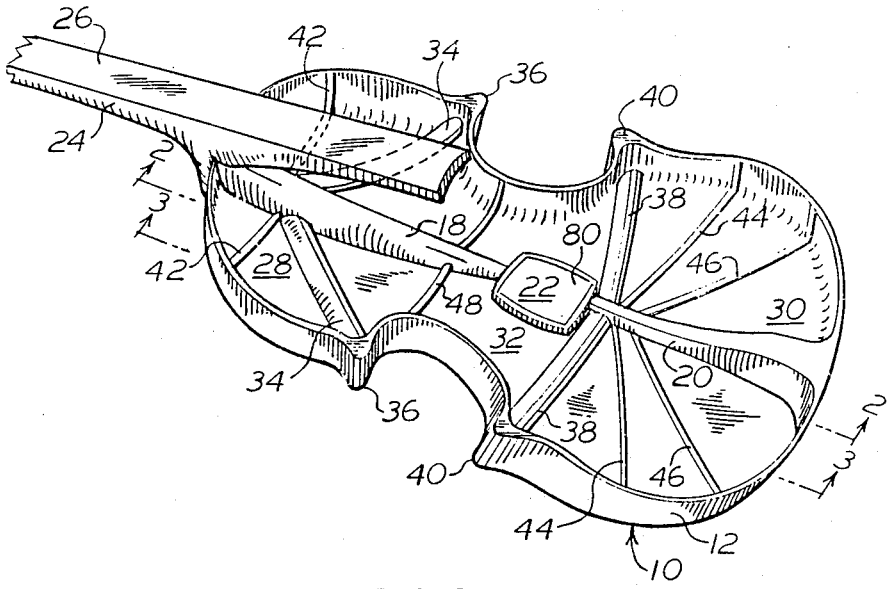
FIG. 1 is a perspective view of the lower sound box with a portion of the handle.

DETAILED DESCRIPTION OF THE INVENTION:

The violin according to the present invention comprises a lower sound board 10, a sidewall 12 and an upper sound board 14. The three parts 10, 12 and 14 are made essentially of molded plastic. The steps in the construction of the violin may vary. For instance, the sidewall 12 may be molded in one piece with the lower sound board 10 and the upper sound board 14 is subsequently sealed to the sidewall 12. Another alternative is that each of the lower and upper sound boards 10 and 14 are molded with half the height of the sidewall 12 and subsequently both half of the sidewall are sealed together to complete the sound box of the violin. In the present description, the lower sound board 10 is described as molded with the complete sidewall 12.

Figure 2:
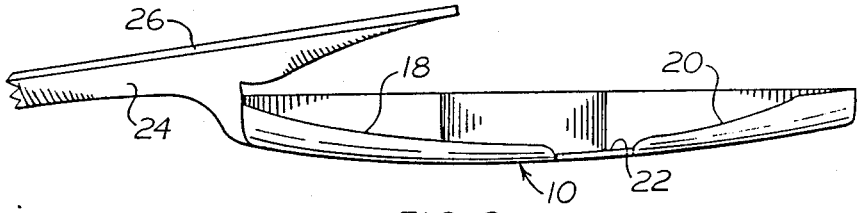
FIG. 2 is a cross-sectional view of the lower sound box along line II—II of FIG. 1.
Figure 3:
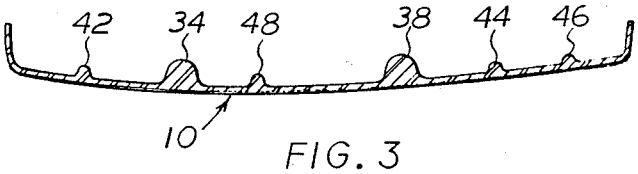
FIG. 3 is a cross-sectional view along line III—III of FIG. 1, FIGS. 4 & 5 are top plan views of the lower board illustrating two different of secondary ribs molded on the surface of the lower board.

The lower board as shown in FIGS. 1, 2 and 3 has a substantially uniform thickness although it as the usual belly curve as shown in FIG. 3. The lower board 12 is reinforced by a large rib 16 which extends along the longitudinal axis of the violin. The rib 16 is made of two tapered portions 18 and 20 having a cross-section which decreases from the sidewall to the central portion of the violin. The central portion is occupied by a relatively flat and thickened internal portion 22. The rib 18 is preferably molded with a core made of hard wood such as maple. Both portions 18 and 20 of the rib 16 taper along both their vertical and horizontal cross-sections. The height of the rib 16 adjacent the sidewall is substantially equal to the height of the sidewall 12 and tapers to a height substantially corresponding to the central portion 22.

The violin has a handle 24 which is preferably molded with the lower box 10 and extends substantially from the large rib 16. In a preferred embodiment, the wooden core which extends in the rib portion 18 also extends in a portion of the handle 24 to add rigidity to the violin. A finger board 26 is subsequently secured to the handle 24.

A set of additional secondary ribs are also molded on the internal surface of the lower board 10 to add rigidity to the board 10 and to provide the desired musicality to the instrument. The secondary ribs have a plurality of shapes according to the sound desired but the secondary ribs have the same pattern on both sides of the large rib 16.

The box of the violin comprises three sections, that is, the upper box 28 adjacent the handle, the lower box 30 and the neck portion 32. The upper box 28 is reinforced by a secondary rib 34 extending between the corners 36 of the neck portion 32 and the central portion of the upper box 28 adjacent the rib 18. Another secondary rib 38 is molded over the lower box 30 and extend between the corners 40 of the neck portion 32 and the rib 20 adjacent its smaller section.

Ribs of smaller diameters than the secondary ribs are also added to radiate across the surface of the upper and lower boxes. In the upper box 28, small ribs 42 extends across the lower board to form an X-shaped with the secondary rib 34. In the lower box 30, ribs 44 and 46 are molded on the lower board 10 between the small section of the large rib 20 and various part of the periphery of the violin. The neck portion 32 is reinforced by a small rib 48 which extends diametrically across the neck portion 32. All the secondary ribs and the small ribs can be made to extend over the internal surface of the sidewall 12 for additional reinforcement.

Although, the ribs described in FIGS. 1, 2 and 3 have been referred to as reinforcing ribs, the pattern may substantially change to vary the musical rendition of the instrument.

Figure 4:
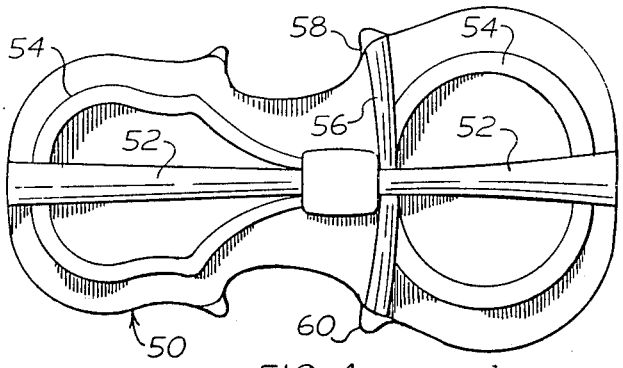
Figure 5:
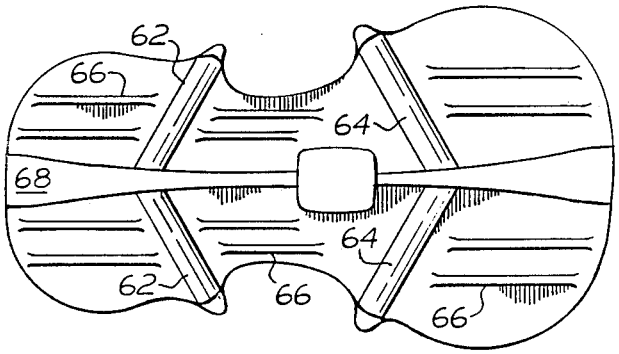

In FIGS. 4 and 5, ribs of different patterns are illustrated. In FIG. 4, the lower sound board is molded with a large axial rib 52 corresponding to rib 16 illustrated in FIG. 1 and with a secondary rib 54 which substantially follows a path corresponding to the contour of the instrument. Another secondary rib extends from the main rib 5 up to the corners 58 and 60 of the neck portion. In FIG. 5, in addition to the secondary rib 62 and 64, a series of discontinuous small ribs 66 are molded substantially parallel to the main 68. A violin maker producing a violin according to the present invention can achieve a variety of sound effect by varying the pattern of the ribs molded on the surface of the lower board.

Figure 6:
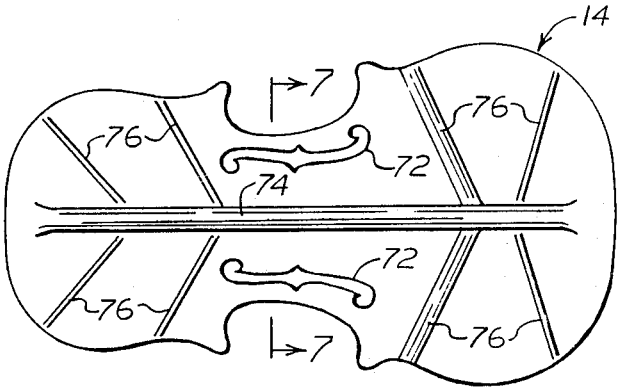
FIG. 6 is a perspective view of the inner surface of the upper sound board.
Figure 7:
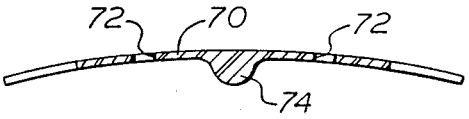
FIG. 7 is a cross-sectional view taken along line VII—VII of FIG. 6.

FIGS. 6 and 7 illustrate the upper sound board 70 which has a uniform thickness with the usual belly shape and sound holes 72. The upper board 70 as a main large rib 74 extending along the longitudinal axis of the board 70. From the large rib 74, secondary ribs 76 extend radially towards the periphery of the upper and lower box.

When the upper board 70 is mounted over the sidewall 12 shown in FIG. 1, the usual sound post is mounted between the upper and lower board 70 and 10 preferably before the upper board 70 is sealed to the sidewall 12. In order, to help the sound post to stand and maintain its position during the sealing operation, the sound post is made with a tapered end which will be located in a recess 80 provided in the flat thickened portion 22.

The molded violin is made of plastic and in particular of resin, fiberglass and/or fiber plastic. Its construction makes the instrumetnt unaffected by relatively high and low temperature and by humidity. An appropriate molding process can produce the desired finish and color without the need for painting, polishing, varnishing which are required in the usual string instrument.

String instruments according to the present invention can make use in the same molding, of the peg box construction as described in U.S. Pat. No. 4,735,124.

The technic of construction of violins herein described, can be used for cellos, double-bass or the like. The diagram needs to be accordingly suited. The ribs which are molded with the lower and upper sound boards such as 10 and 14 may be referred to as an integrated diagram which is adapted to produce a wide variety of high and low pitched sounds.

I claim:

1. A sound box and a handle for violin or the like made of molded plastic, said box comprising a lower and an upper sound board and an intermediate surrounding sidewall sealed to the lower and upper sound boards, each of said sound boards having an upper and a lower box connected by a neck portion delineated by a C-shape forming corners with the upper and lower boxes, said lower board having a generally uniform thickness, a large rib sealed on said lower board and to said sidewall along the longitudinal axis of the violin, the height of the large rib adjacent the sidewall being substantially equal to the height of the sidewall, the cross-section of said large rib tapering down from both ends to the center portion of the lower board, said handle being molded with said lower sound board and said large rib and integrally extending from said large rib, two series of secondary ribs sealed to the lower board, each series irradiating from the large rib, displaying a similar pattern on both sides of the large rib.

2. A sound box as recited in claim 1, wherein the secondary ribs includes two pairs of ribs, each pair displaying a V-shape the apex of the V-shape being located on the large rib and integrally molded with the latter and the lower sound board, the free end of the V-shape projecting towards the corners of the C's of the box.

3. A sound box as recited in claim 2, wherein a plurality of secondary ribs irradiate from the large rib in each of the lower and upper box towards the sidewalls.

4. A sound box as recited in claim 3, wherein the said secondary ribs extends on the inner face of the sidewall.

5. A sound box as recited in claim 2, wherein the secondary ribs are substantially made of a plurality of discontinuous thick small ribs on the lower board, the said discontinuous ribs being substantially parallel to the longitudinal axis of the violin.

6. A sound box as recited in claim 1, wherein the lower board has a flat thickened surface adjacent the center portion of said box, said thickened surface being located at the most tapered end of the large rib.

7. a sound box as recited in claim 6, wherein the thickened surface is provided with a recess for holding a sound post adapted to be mounted between the upper and lower sound board.

8. A sound box as recited in claim 1, wherein the upper sound board is sealed to the sidewalls.

9. A sound box as recited in claim 1, comprising a core made of hard wood integrally extending from the large rib into at least a portion of the handle.

10. A sond box as recited in claim 1, wherein said large rib and said handle have a core made of hard wood.

11. A sound box as recited in claim 10, wherein the molded plastic is made of a resin and/or fiberglass.

* * * * *